US006237784B1

(12) United States Patent
Primiano

(10) Patent No.: US 6,237,784 B1
(45) Date of Patent: May 29, 2001

(54) LABEL ORIENTING DISPLAY RACK

(75) Inventor: Bernard Primiano, Marietta, GA (US)

(73) Assignee: Display Industries, LLC., Smyrna, GA (US)

( * ) Notice: Subject to any disclaimer, the term of this patent is extended or adjusted under 35 U.S.C. 154(b) by 0 days.

(21) Appl. No.: 09/454,759

(22) Filed: Dec. 6, 1999

(51) Int. Cl.[7] ..... A47F 1/04
(52) U.S. Cl. ..... 211/59.2; 211/74
(58) Field of Search ..... 211/59.2, 59.3, 211/74; 312/35, 45, 72

(56) References Cited

U.S. PATENT DOCUMENTS 5,531,336 * 7/1996 Parham et al. ..... 211/59.2 X
5,562,217 * 10/1996 Salveson et al. ..... 211/59.3
5,992,650 * 11/1999 Lord ..... 211/59.2

* cited by examiner

*Primary Examiner*—Daniel P. Stodola
*Assistant Examiner*—Erica B. Harris
(74) *Attorney, Agent, or Firm*—John L. James

(57) ABSTRACT

A beverage display rack provides a track on which beverage containers slide forward for dispensing. A rib on the track engages a groove in the beverage container. The groove has a predefined relationship with the label on the container so that the label faces forward when the rib engages the groove. The rib can be an upstanding rib which extends upward from the bottom of the track or can extend inward from the sidewall of the track toward the center of the display rack to engage a groove in the beverage container. Existing display racks can be retrofitted with an insert that fits in the track and has a protruding rib to engage the beverage container.

2 Claims, 4 Drawing Sheets

LABEL ORIENTING DISPLAY RACK

FIELD OF THE INVENTION

The present invention relates generally to a display rack for displaying beverage bottles in a refrigerator, and, more particularly, to a device for orienting the bottles so that bottle labels face forward.

BACKGROUND OF THE INVENTION

Display racks are used to shelve merchandise awaiting purchase by a consumer. Some items, such as beverages, are best when consumed chilled, and are consequently shelved in a refrigerator. Display racks are used in the refrigerator to keep beverage containers upright for easy viewing and to dispense them one at a time. Beverages are removed one at a time from the front of the rack and the remaining inventory is urged to the front of the rack for easy removal. Shelf stocking conveniently occurs from the rear of the rack ensuring that beverages are chilled when they reach the front of the rack. Presentation of the beverage is very important; so, a viewing area at the front of the rack allows easy viewing of the label area of the beverage container. Unfortunately, in many instances where beverages are displayed in racks, the beverage containers are not perfectly aligned with the labels facing forward for easy viewing because of the time required to align them and because rack stockers are generally not that attentive. In addition, even when initially perfectly aligned, they are subject to disturbance as consumers remove containers from the display. Accordingly, it will be appreciated that it would be highly desirable to have a display rack that aligns the beverage label in the viewing area so that container labels face forward and prevents disturbance as containers are removed.

SUMMARY OF THE INVENTION

Briefly summarized, according to one aspect of the present invention, a display rack comprises an elongate track base for carrying a row of articles for sliding movement, a rib upstanding from the track base for engaging a groove in each article of the row of articles to thereby orient the articles, and at least one article guiding sidewall upstanding from the track base. The rib may be laterally positioned in the center of the track base or offset from the center. When the upstanding rib engages the groove, the container is automatically oriented with the label facing forward.

According to another aspect of the invention, a display rack comprises an elongate track base having a plurality of upstanding ribs, and at least one article guiding sidewall upstanding from the track base to limit lateral movement of the articles. An insert is positioned on the ribs of the track base for carrying a row of articles for sliding movement along the insert. The insert has an upstanding rib for engaging a groove in each article of the row of articles to thereby orient the articles with labels facing forward. It also has a plurality of shorter secondary ribs parallel to the upstanding rib for sliding contact with the articles. A number of tertiary ribs on the underside of the insert are parallel to the upstanding rib but extend in the opposite direction from the upstanding rib to interstitially engage the ribs of the track base.

In another aspect of the invention, a display rack comprises an elongate track base for carrying a row of articles for sliding movement along the track base, and at least one article guiding sidewall upstanding from the track base. One of the sidewall and track base has a protruding rib for engaging a groove in each article of the row of articles to thereby orient the articles with labels facing forward.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
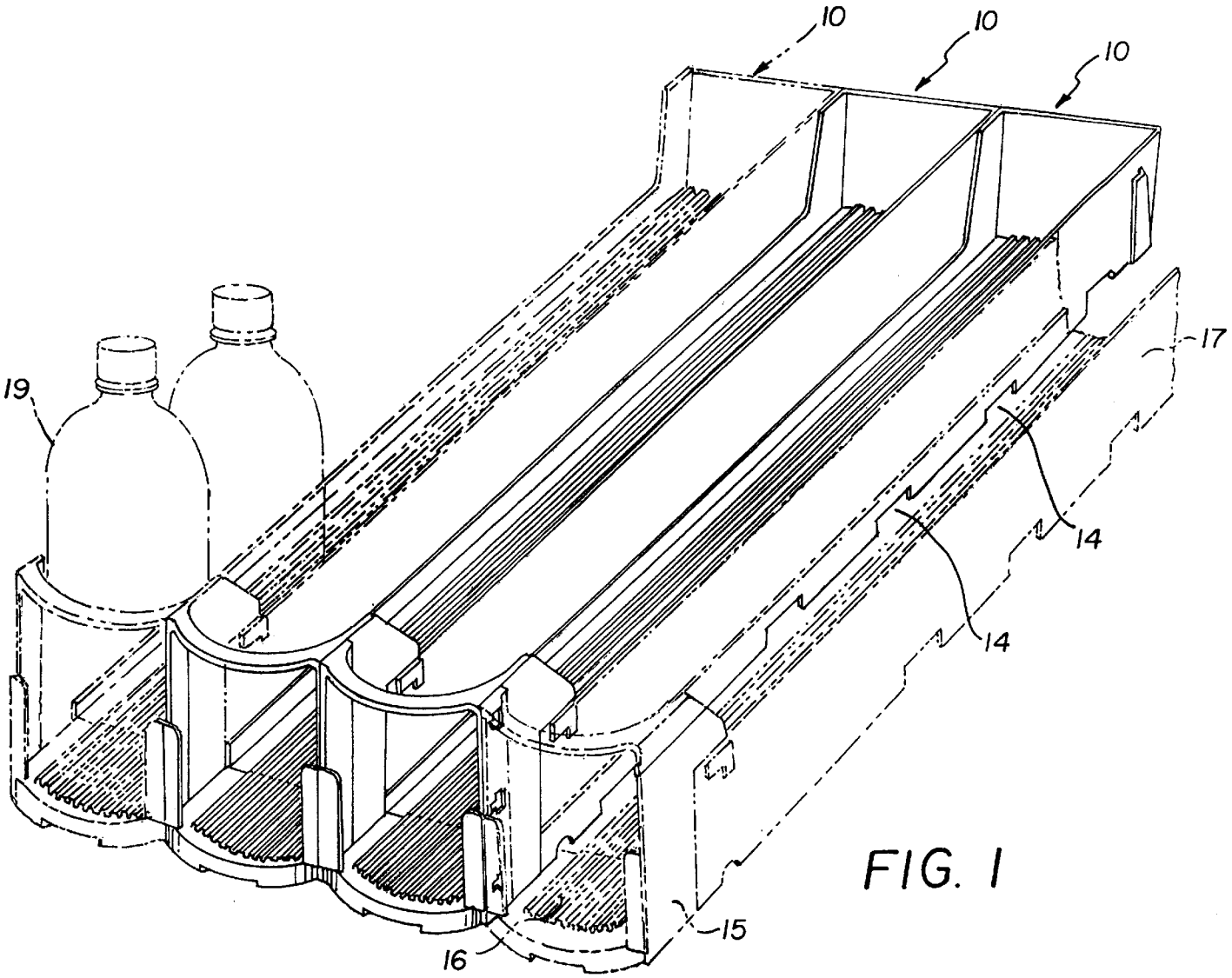
FIG. 1 is a perspective view of a display rack unit assembled from a plurality of track devices.

Referring to FIG. 1, a display rack unit assembled from multiple track devices is designed to merchandise articles such as bottled or canned drink products. The display rack unit includes a plurality of elongated track devices 10 detachably interconnected in a side-by-side, transversely adjacent relationship. The number of track devices used to assemble the display rack unit is determined such that the size of the unit is suitable for placement onto an existing display shelf in a retail environment. The interconnection of two adjacent track devices is achieved by connecting means such as connector slots 14 cooperating with L-shaped horizontal connector elements. Details of the track devices and connector elements are more filly described in U.S. Pat. No. 5,634,564, which issued Jun. 3, 1997 to Spamer et al., the disclosure of which is incorporated herein by reference. The unit may be supported on a horizontal surface and may preferably have a spring-loaded pusher for moving the articles forward. However, the unit may also be supported on forwardly and downwardly tilted surfaces. In a tilted condition, each track device operates as a so called "gravity feed" dispensing device which does not require any mechanical pushers. In a gravity feed device, the loaded articles have a natural tendency to automatically slide downwardly and forwardly to the front end of the track. The track device has a two-piece construction formed of molded plastic material and includes a front piece 15 and an elongated track body. The track body has an article supporting base 16 and an article guiding sidewall 17 upstanding from the base. The track base 16, the sidewall 17 attached to the track base, and the sidewall 18 of the adjacent track body define a channel for receiving a row of containers 19.

Figure 2:
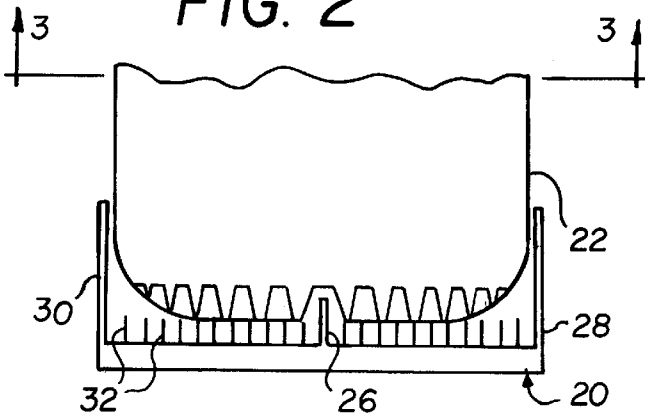
FIG. 2 is a diagrammatic sectional view taken along line 2—2 of FIG. 3 illustrating a preferred embodiment of a display rack incorporating a bottle label orienting device according to the present invention.
Figure 3:
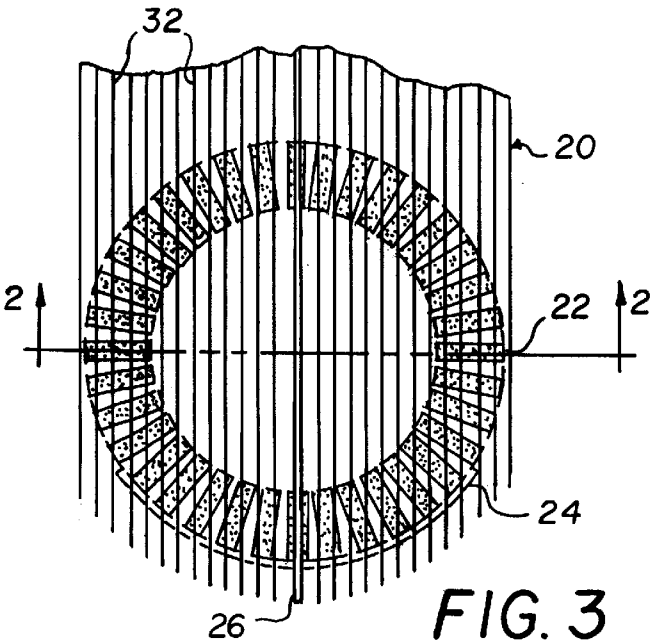
FIG. 3 is a diagrammatic sectional view taken along line 3—3 of FIG. 2.

Referring to FIGS. 2–3, a display rack has an elongated track base 20 for carrying a row of articles, such as beverage bottles 22, to be dispensed one at a time. Each bottle 22 preferably has a plurality of grooves molded into its bottom and has a product label 24 attached to its sidewall. Typically, the bottle bottom is not flat but has a raised central portion so that only a circular band near the perimeter of the bottom contacts the surface on which the bottle sits. By this construction a reduced friction bottle is formed that slides easily along a track base, and which resists distortion. Each groove lies along a diameter of the bottom so that when a groove is divided into segment by the raised central portion of the bottom, the segments are diametrically aligned. Product label 24 is always centered above one of the grooves.

Track base 20 has a centrally located rib 26 extending upward to engage one of the grooves in the bottom of the bottle. By orienting the bottle with the product label facing forward, the engagement of the rib and groove maintain the orientation. When engaged, the rib and groove prevent rotation of the bottle thereby maintaining the orientation of the product label. Sidewalls 28, 30 extending from track base 20 inhibit lateral movement of the bottle to keep it from tipping, and to guide the bottles along the track base. Secondary ribs 32 on the track base further reduce friction between the bottle and track base. Secondary ribs 32 have a lower height than positioning rib 26.

Figure 4:
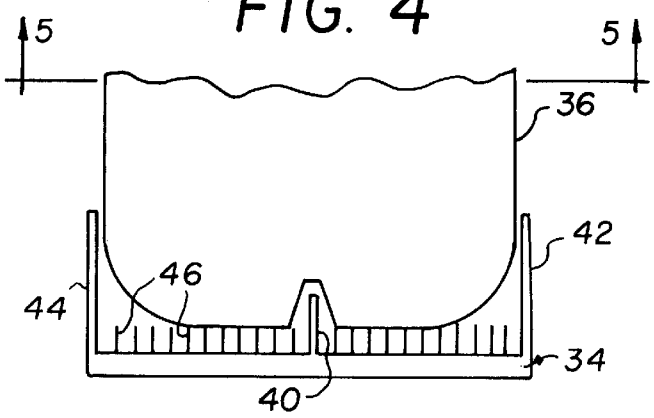
FIG. 4 is a diagrammatic sectional view taken along line 4—4 of FIG. 5 illustrating another preferred embodiment of a display rack incorporating a bottle label orienting device according to the present invention.
Figure 5:
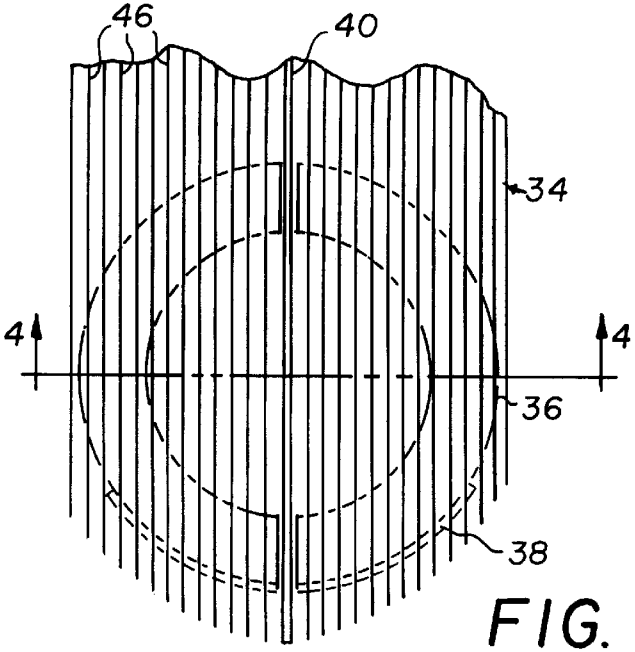
FIG. 5 is a diagrammatic sectional view taken along line 5—5 of FIG. 4.

Referring to FIGS. 4–5, a display rack has an elongated track base 34 for carrying a row of beverage bottles 36. Each bottle 36 has a single diametrical groove molded into its bottom and has a product label 38 centered over the groove. Track base 34 has a centrally located rib 40 extending upward to engage the groove. By orienting the bottle with the product label facing forward, the engagement the rib and groove maintain the orientation. Sidewalls 42, 44 extending from track base 20 inhibit lateral movement of the bottle, and secondary ribs 46 on the track base reduce friction between the bottle and track base.

Alternatively, there could be a single groove offset to one side of the diameter with the product label positioned relative to the single groove to face forward. Such groove position would allow the bottle to be inserted in only one way with no chance for error because incorrect positioning would cause the bottle to wobble. With any construction, when the positioning rib engages the groove, the product label orientation does not change thereby giving the product label maximum exposure.

Figure 6:
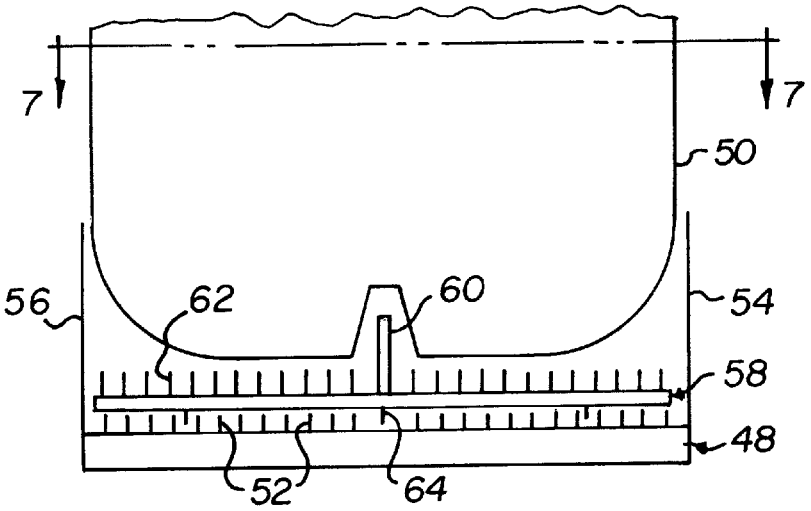
FIG. 6 is a diagrammatic sectional view taken along line 6—6 of FIG. 7 illustrating another preferred embodiment of a display rack incorporating a bottle label orienting device according to the present invention.
Figure 7:
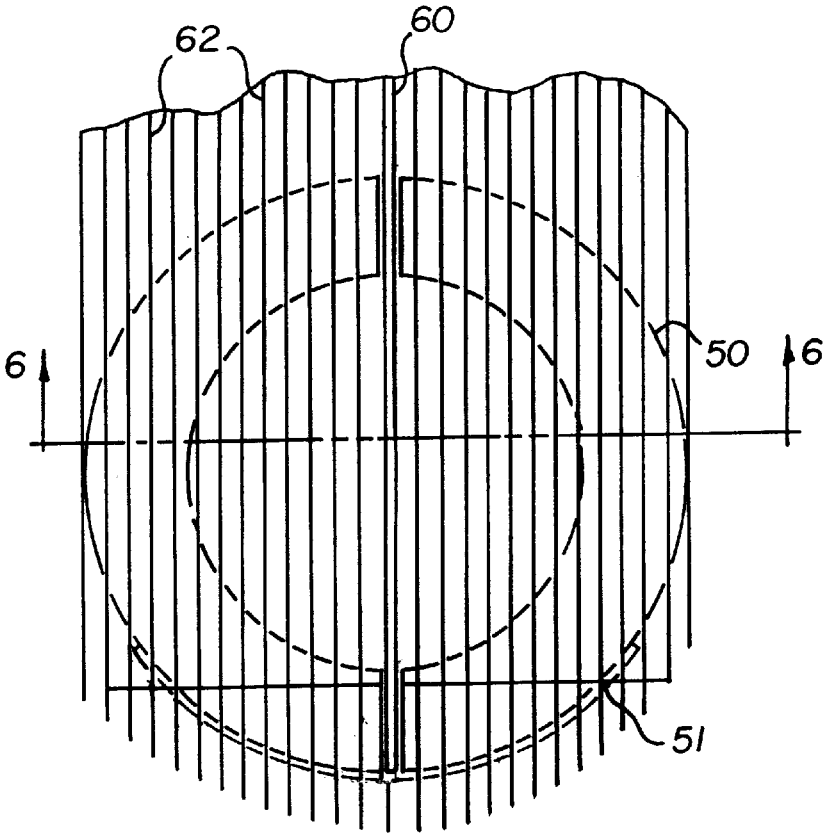
FIG. 7 is a diagrammatic sectional view taken along line 7—7 of FIG. 6.
Figure 9:
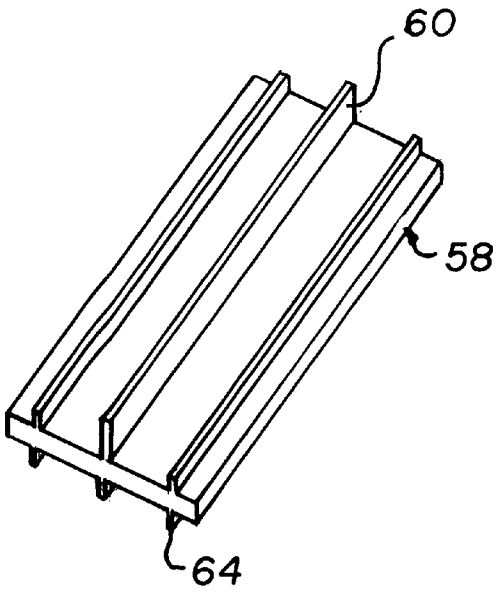
FIG. 9 is a perspective view of a bottle label orienting device similar to FIG. 8 but illustrating another preferred embodiment.

Referring to FIGS. 6–7 and 9, a display rack has an elongated track base 48 for carrying a row of beverage bottles 50. Each bottle 50 has at least one diametrically positioned groove molded into its bottom and has a product label 51 centered over the groove on its sidewall. A plurality of upstanding ribs 52 extend from track base 48 as do sidewalls 54, 56. An insert 58 positioned on track base 48 between the sidewalls 54, 56 rests on ribs 52. Insert 58 has an upstanding positioning rib 60 that is preferably laterally positioned in the center of the insert and thereby positionable in the center of the track base. Central positioning rib 60 engages the diametrical groove. Insert 58 may also have a plurality of friction reducing secondary ribs 62 on either side of and parallel to central rib 60 for sliding engagement with bottle 50. Secondary ribs 62 are shorter than central positioning rib 60. Ribs 60, 62 extend from the top side on the insert while tertiary ribs 64 extend downward from the bottom side if the insert. Tertiary ribs 64 are parallel to central rib 60 but extend in the opposite direction to interstitially engage ribs 52 on track base 48.

Figure 8:
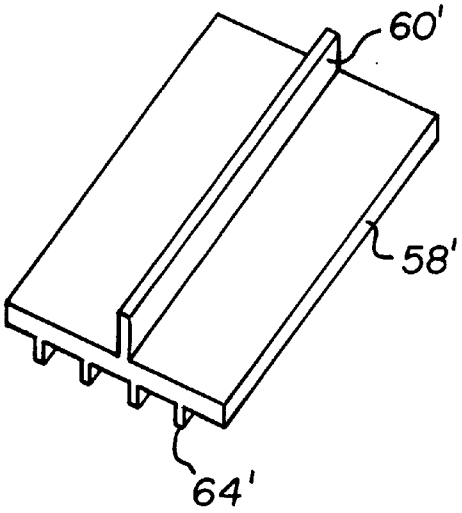
FIG. 8 is a perspective view of the bottle label orienting device of FIGS. 6 and 7.

FIG. 8 illustrates an insert 58' that has an upstanding positioning rib 60' that is preferably laterally positioned in the center of the insert and thereby positionable in the center of the track base to engage the diametrical groove of the bottle. Insert 58' also has a plurality of tertiary ribs 64' extending downward from the bottom side if the insert. Tertiary ribs 64' are parallel to central rib 60' but extend in the opposite direction to interstitially engage ribs 52 on track base 48. Insert 58' is void of secondary ribs offering a simpler construction where the bottom of the bottle has multiple ribs and grooves to reduce friction.

Figure 10:
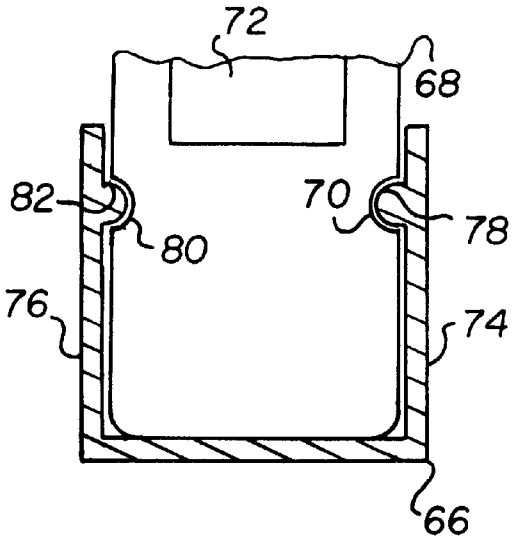
FIG. 10 is a diagrammatic sectional view taken of a display rack incorporating a bottle label orienting device similar to FIG. 2 but illustrating another preferred embodiment.

Referring to FIG. 10, a display rack has an elongated track base 66 for carrying a row of beverage bottles 68. Each bottle 68 has at least one horizontally extending groove 70 molded into its sidewall and has a product label 72 centered over track base 66. Sidewalls 74, 76 extend upward from track base 66. Sidewall 74 has a positioning rib 78 for engaging groove 70 to orient bottle 68 with the label facing forward. A single groove 70 engaging a positioning rib 78 has the advantage of allowing bottle 68 to be inserted between sidewalls only one way. A second groove 80 may be added to engage a second rib 82 protruding from the other sidewall 76. Dual grooves have the advantage of allowing looser tolerances between the bottle and sidewalls which is desirable to accommodate distortion of the sidewalls caused by environmental conditions, bottle distortion or by bottle contact during loading or dispensing.

It can now be appreciated that the display rack provides a rib for engaging a groove in a bottle to first orient the bottle with the bottle label facing forward, and then to prevent the bottle from rotating to thereby keep the bottle label facing forward. The stock person inserts bottles from the rear while turning the bottle so that the bottle label faces forward. When properly aligned, the bottle slips down over the upstanding positioning rib and resists further turning. Once aligned, the bottle stays aligned thereby keeping the label properly positioned in the viewing area. Where the rib extends from the sidewall instead of the base, it works the same way. As the bottle is turned by the stock person, the sidewall rib slips into the bottle groove to prevent rotation and orient the bottle with the label facing forward. The positioning rib can be integrally formed with the track base or sidewall, or can be in the form of an insert that fits on the track base.

Where an insert is used, the display rack comprises an elongated track base with a plurality of upstanding ribs, and at least one bottle guiding sidewall upstanding from the track base to limit lateral movement of the bottle. The insert is positioned on the ribs of the track base for carrying a row of bottles for sliding movement along the insert. The insert has an upstanding positioning rib for engaging a groove in each bottle of the row of bottles to thereby orient the bottles with labels facing forward. It also has a plurality of shorter secondary ribs parallel to the upstanding positioning rib for sliding contact with the bottles. A number of tertiary ribs on the underside of the insert are parallel to the upstanding rib but extend in the opposite direction from the upstanding rib to interstitially engage the ribs of the track base. The insert can be used with existing display racks to keep bottle labels facing forward thereby extending the useful life of existing equipment.

While the invention has been described with particular reference to the preferred embodiments, it will be understood by those skilled in the art that various changes may be made and equivalents may be substituted for elements of the preferred embodiments without departing from invention. For example, multiple positioning ribs could be used. It is accordingly intended that the claims shall cover all such modifications and applications as do not depart from the true spirit and scope of the invention.

What is claimed is:

1. A display rack, comprising:

an elongate track base having a plurality of upstanding ribs;

at least one article guiding sidewall upstanding from said track base to limit lateral movement of articles in said track; and an insert positioned on said ribs of said track base for carrying a row of articles for sliding movement along said insert, said insert having an upstanding rib for engaging a groove in each article of said row of articles to thereby orient said articles, said rib of said insert being laterally positioned in the center of said track base, said insert having a plurality of secondary ribs parallel to said upstanding rib on said insert for sliding engagement with said articles, said secondary ribs having lower heights than said upstanding rib.

2. A display rack, as set forth in claim 1, including a plurality of tertiary ribs parallel to said upstanding rib on said insert but extending in an opposite direction from said upstanding rib for interstitial engagement with said ribs of said track base.

* * * * *